US006068469A

United States Patent [19]

Gengo et al.

[11] Patent Number: 6,068,469

[45] Date of Patent: May 30, 2000

[54] COMBUSTION APPARATUS

[75] Inventors: Tadashi Gengo; Kouichi Sakamoto, both of Tokyo; Keishi Suga, Nagasaki, all of Japan

[73] Assignee: Mitsubishi Heavy Industries, Ltd., Tokyo, Japan

[21] Appl. No.: 09/186,799

[22] Filed: Nov. 5, 1998

[30] Foreign Application Priority Data

Nov. 5, 1997 [JP] Japan ..... 9-302652
Nov. 5, 1997 [JP] Japan ..... 9-302653

[51] Int. Cl.[7] ..... F23C 5/32

[52] U.S. Cl. ..... 431/176; 431/175

[58] Field of Search ..... 431/175, 176, 431/174, 264, 265, 263, 297, 347

[56] References Cited

U.S. PATENT DOCUMENTS

| | | | |
|---|---|---|---|
| 3,174,735 | 3/1965 | McFadden | 431/175 |
| 4,294,178 | 10/1981 | Borio et al. . | |
| 5,146,858 | 9/1992 | Tokuda et al. | 110/264 |

FOREIGN PATENT DOCUMENTS

| | | | |
|---|---|---|---|
| 185918 | 6/1956 | Austria . | |
| 0 022 454 | 1/1981 | European Pat. Off. . | |
| 57-164207 | 10/1982 | Japan | 431/175 |
| 3-134403 | 6/1991 | Japan | 110/265 |
| 1695039 | 11/1991 | U.S.S.R. | 431/175 |
| 1710938 | 2/1992 | U.S.S.R. . | |

OTHER PUBLICATIONS

Soviet Inventions Illustrated, Section P,Q, week 9252, London: Derwent Publications Ltd., Class Q73, AN 92–431506/52; & SU 1710938 A1 (SISE).

Beitz, W. et al., Tangential–feuerung. Dubbel Taschenbuch fur den Maschinenbau, 1981, pp. 572, Chapter 2.2.

European Search Report, EP 98308519.2 completed Apr. 2, 1999 by Bistrich, Vienna.

*Primary Examiner*—Ira S. Lazarus
*Assistant Examiner*—Sara Clarke
*Attorney, Agent, or Firm*—Alston & Bird LLP

[57] ABSTRACT

An object of the present invention is to provide a combustion apparatus in which a space which does not contribute effectively to the combustion of fuel is less prone to be produced in a furnace because burners are not disposed at the corners of the furnace.

The furnace having a square horizontal cross section is provided with the burners so that an in-furnace injection direction axis line of the burner is tangent to an imaginary circle. The burner is disposed at one place on a front wall, rear wall, right side wall, and left side wall of the furnace each, at a total of four places. The burner on each wall is installed so that the intersection of the in-furnace injection direction axis line of the burner and the furnace wall surface is apart from a furnace corner (corner point) by a length L1. The value of the length L1 is 15% of a length L of one side of width of the inside wall of the furnace when the furnace is viewed from the top.

12 Claims, 15 Drawing Sheets

COMBUSTION APPARATUS

BACKGROUND OF THE INVENTION AND RELATED ART STATEMENT

1. Field of the Invention

The present invention relates to a combustion apparatus applied to boilers for thermal power plants or chemical plants, or furnaces and the like for the chemical industry.

2. Description of Related Art

FIG. 14 is a horizontal sectional view showing a conventional boiler furnace using a rotational combustion system and the concept of a combustion flame in the furnace.

As shown in the figure, a square furnace 1 is provided with burners 6 for injecting fuel at four corners 10.

FIG. 15 shows another furnace 1 of the prior art. Unlike the furnace shown in FIG. 14, the furnace 1 is provided with burners 6 at two places on the furnace front wall 2 and at two places on the furnace rear wall 3, not at the furnace corners 10. In this case, the burners 6 are not disposed on the right and left side walls 4 and 5 of the furnace. Other configurations are the same as those shown in FIG. 14.

The furnace 1 shown in FIGS. 14 and 15 has an imaginary circle 7 having a fixed diameter, which is set in the furnace interior 1*a*. Also, in these figures, in-furnace injection direction axis lines 9 showing the direction of fuel and combustion air of burner are set so as to be tangent to the imaginary circle 7. The fuel and combustion air injected from the burner 6 into the furnace 1 are injected into a furnace interior 1*a*along this axis line, thereby forming a rotational combustion flame 8.

In the prior art, in order to form a stable and high-performance rotational combustion flame, all the burners 6 are disposed at the furnace corners 10 as shown in FIG. 14, or they are disposed on the furnace walls opposed to each other, that is, on the furnace front wall 2 and the furnace rear wall 3 as shown in FIG. 15, or they are disposed on the furnace right side wall 4 and the furnace left side wall 5, and an appropriate diameter of the imaginary circle 7 is selected to obtain a stable rotational combustion flame.

FIG. 16 shows a furnace 21 for a boiler or the like. As shown in the figure, the furnace 21 is provided with burners 25 at four places on the furnace front wall 22 and at four places on the furnace rear wall 23. Of these burners 25, four burners 25 disposed on the right side in the figure are arranged so that the in-furnace injection direction axis line 28 showing the direction of the fuel and combustion air injected from the burner 25 is tangent to the circumference of an imaginary circle imagined in the furnace 21, having a fixed diameter, and four burners 25 disposed on the left side in the figure are also arranged likewise so that an imaginary circle 26 is set. The fuel and combustion air injected from the burner 25 are injected into a furnace interior 21*a* along the axis line 28 and burned, thereby forming a flame 27. In the furnace 21, therefore, two rotational combustion flame vortexes having a different center position are formed.

In the prior art, all of the burners 25 are disposed on a set of opposed furnace walls, the furnace front wall 22 and the furnace rear wall 23, and the diameter of the imaginary circle 26 is selected appropriately, whereby stable and proper rotational combustion flame vortexes 29 are formed.

OBJECT AND SUMMARY OF THE INVENTION

When the burners 6 are disposed at the corners 10 of the furnace 1 as shown in FIG. 14, steel frames for supporting the boiler and pipes for supplying fuel to the burners 6 are concentrated at the corner portions of the boiler, so that a shortage occurs of a maintenance space for pulling out the burner 6 to the outside of the furnace 1 at the time of maintenance. Also, when the burners 6 are disposed on the opposed front wall 2 and rear wall 3 of the furnace 1 as shown in FIG. 15, there is a fear that a space which does not contribute effectively to the combustion of fuel is produced in the vicinity of the furnace right side wall 4 or the furnace left side wall 5.

The present invention has been made to solve the above problems, and accordingly an object thereof is to provide a combustion apparatus in which a space which does not contribute effectively to the combustion of fuel is less prone to be produced in the furnace because burners are not disposed at the corners of the furnace and the rotational component of fuel gas in the furnace is made uniform.

Also, when the burners 25 are disposed on the front wall 22 and the rear wall 23 of the furnace 21 as shown in FIG. 16, the size of a burner wind box 30 incidental to the furnace 21 is increased as the boiler capacity and the burner size increase as shown in FIG. 17. Therefore, the burner wind boxes 30 come close to each other, so that there is a fear that a shortage maintenance space occurs. Also, for the same reason, the size of a burner panel 32 projecting from the front wall 22 of the furnace 21 toward the outside of the furnace 21 is increased. Thereupon, the body of the whole boiler is made larger unnecessarily, and also the flame 27 is affected by the effect of combustion gas 33 flowing along the inside wall surface of the burner panel 32, so that there is a fear of the possibility that a disturbance is produced in the stable flow of rotational combustion flame vortex 29.

Further, as shown in FIG. 18, comparing with the front wall 22 of the furnace 21, in the vicinity of the rear wall 23, a rear flue 34, a gas duct 35, and various boiler auxiliaries (not shown) are disposed. Therefore, the outside space of the furnace rear wall 23 is very small, and moreover the burners 25 are disposed at four places in that limited space, so that there is a fear that a shortage of maintenance space occurs and the body of the whole boiler is made larger unnecessarily.

The present invention has been made to solve the above problems, and accordingly an object thereof is to provide a combustion apparatus in which a space for facilitating maintenance can be provided on the outside of the furnace rear wall.

To achieve the above objects, the present invention provides a combustion apparatus comprising a furnace having a square transverse cross section and a plurality of burners for forming flame, which are disposed on walls of the furnace so that an injection direction axis line or an extension line thereof of either or both of fuel and combustion air injected from the burner is tangent to an imaginary circle set in the furnace, characterized in that the burners are disposed on all walls of the furnace so that the injection direction axis line of the burner is disposed at a distance less than 25% of the length of one side of width of the furnace inside wall on which the burner is disposed from the end of the furnace inside wall when the furnace is viewed from the top.

Also, to achieve the above objects, the present invention provides a combustion apparatus comprising a furnace having a square transverse cross section and a plurality of burners for forming flame, which are disposed on walls of the furnace so that an injection direction axis line or an extension line thereof of either or both of fuel and combustion air injected from the burner is tangent to an imaginary circle set in the furnace, characterized in that the burners are disposed on all walls of the furnace so that the injection direction axis line of the burner is disposed at a distance less than 25% of the length of the furnace inside wall on which the burner is disposed from the end of the furnace inside wall when the furnace is viewed from the top, and at least one or more burners are disposed so that the injection direction axis line of the burner or the extension line thereof is tangent to one or more second imaginary circles set concentrically with the imaginary circle.

To achieve the above object, the present invention provides a combustion apparatus comprising a furnace having a square transverse cross section and a plurality of burners for forming flame, which are disposed on one pair of opposed walls of the furnace so that an injection direction axis line or an extension line thereof of either or both of fuel and combustion air injected from the burner is tangent to an imaginary circle set in the furnace, and in which at least two or more imaginary circles having a different center position are set in the furnace, characterized in that at least one or more of the burners are disposed on the other pair of opposed walls of the furnace.

DETAILED DESCRIPTION OF PREFERRED EMBODIMENTS

The configuration of a combustion apparatus in accordance with a first embodiment of the present invention will be described below with reference to the accompanying drawings.

Figure 1:
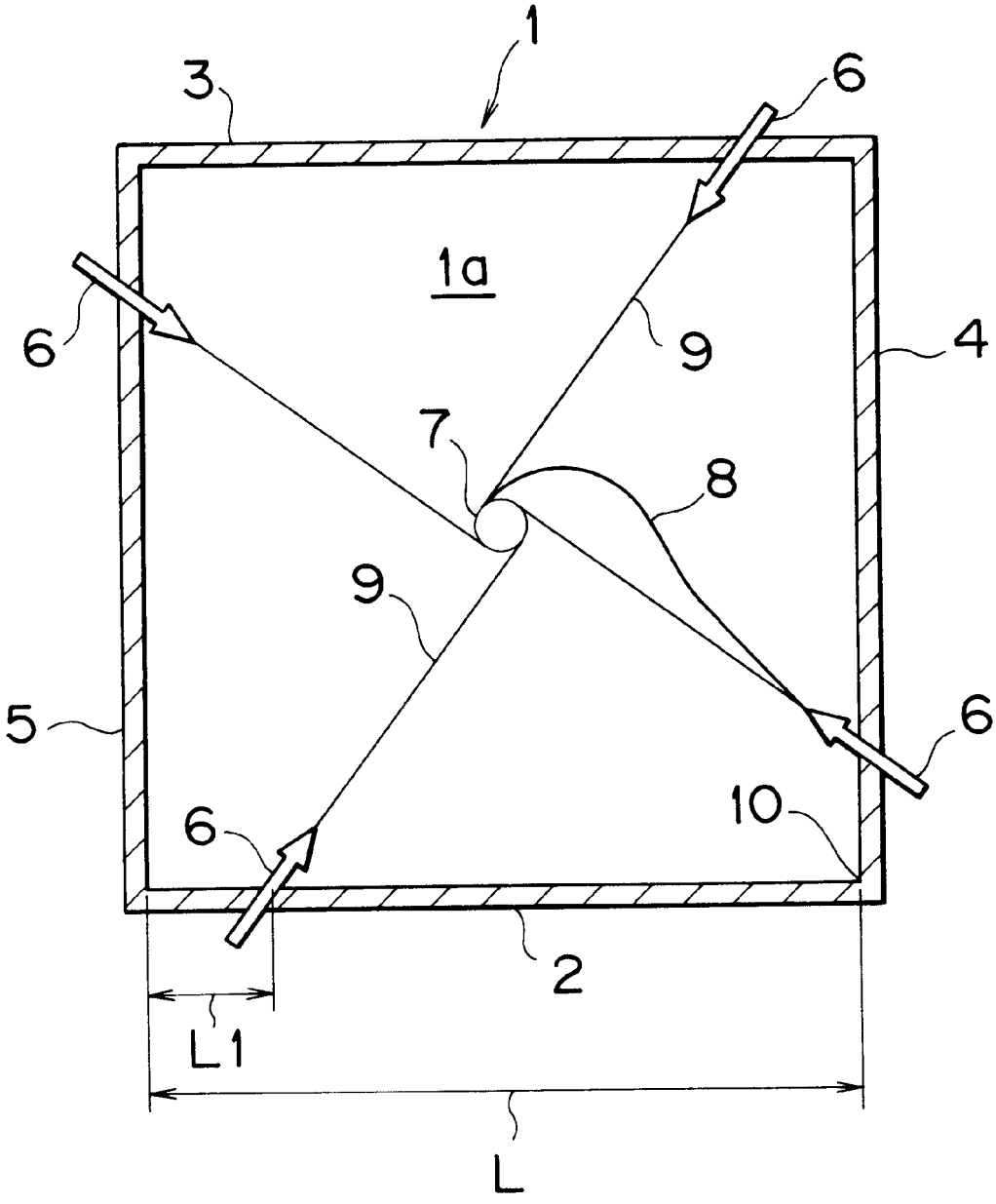
FIG. 1 is a schematic plan view showing a horizontal cross section of a boiler furnace using a combustion apparatus in accordance with a first embodiment of the present invention and the concept of a combustion flame in the cross section.

FIG. 1 shows a furnace 1 using the combustion apparatus in accordance with the present invention. As shown in this figure, the furnace 1 having a square horizontal cross section is provided with burners 6 so that an in-furnace injection direction axis line 9, which is a direction axis line of either or both of fuel and air, is tangent to an imaginary circle 7.

Figure 14:
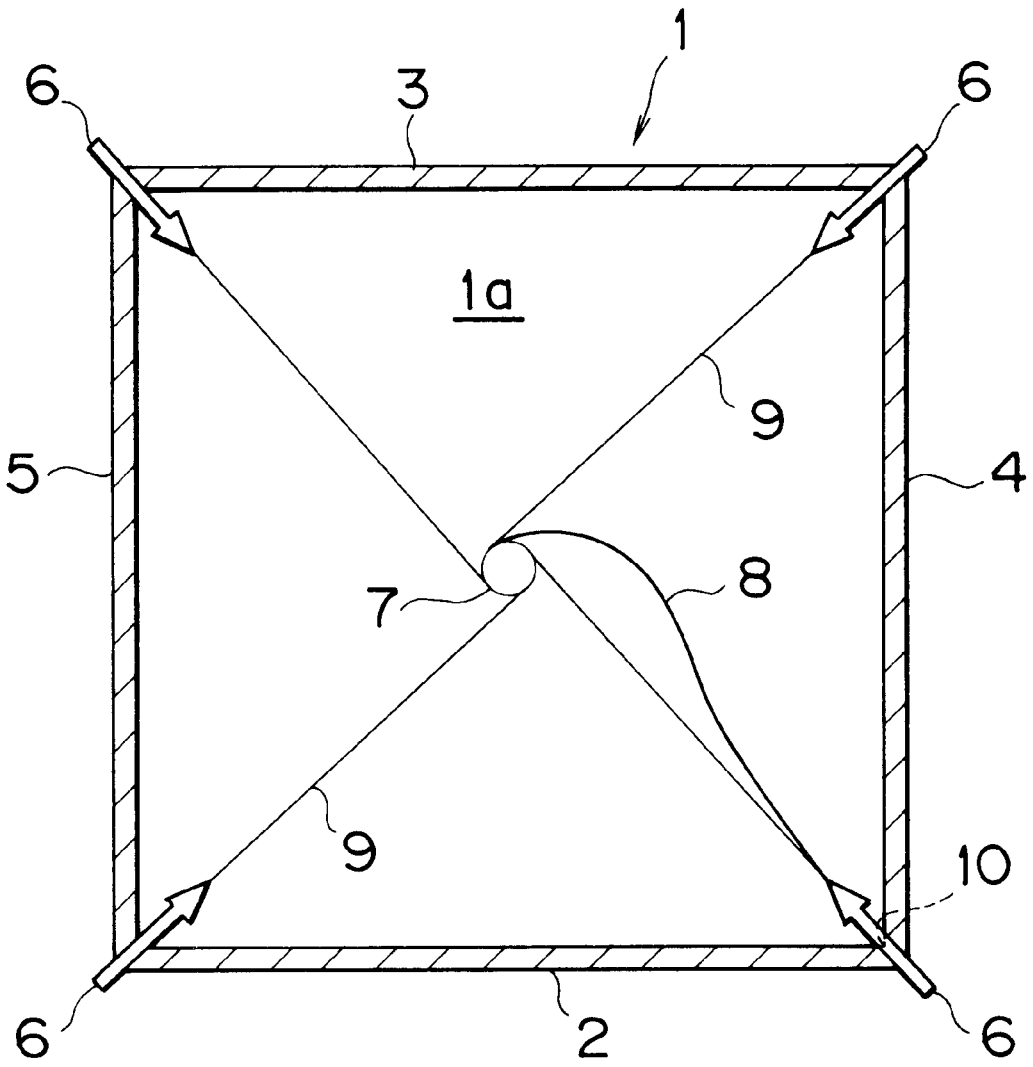
FIG. 14 RELATED ART
FIG. 14 is a schematic plan view showing a horizontal cross section of a conventional boiler furnace and the concept of a combustion flame in the cross section.
Figure 15:
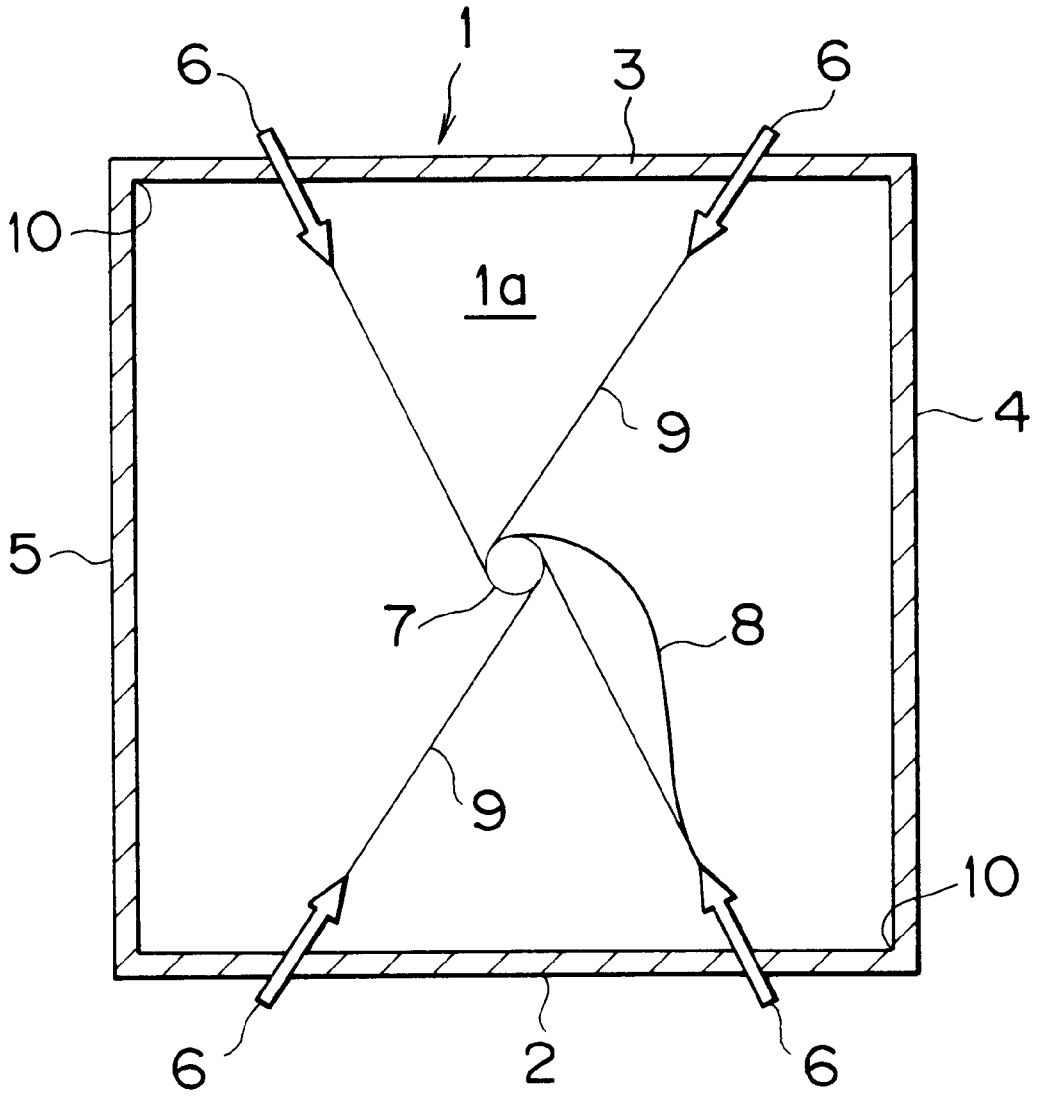
FIG. 15 RELATED ART
FIG. 15 is a schematic plan view showing a horizontal cross section of another conventional boiler furnace and the concept of a combustion flame in the cross section.

The furnace 1 of this embodiment differs from the furnaces shown in FIGS. 14 and 15 in that one of the burners 6 is disposed on each of the front wall 2, rear wall 3, right side wall 4, and left side wall 5 of the furnace each, at a total of four places.

The burner 6 on each wall is installed so that the intersection of the axis line 9 of the burner 6 and the furnace wall surface is apart from a furnace corner (corner point) by a length L1. The value of the length L1 is 15% of a length L of one side of width of the inside wall of the furnace 1 when the furnace 1 is viewed from the top.

In this embodiment, the length L1 on each of the walls is measured in the counterclockwise direction from each of the furnace corners 10 as shown in FIG. 1.

The following is a description of the operation of the first embodiment of the present invention.

Figure 2:
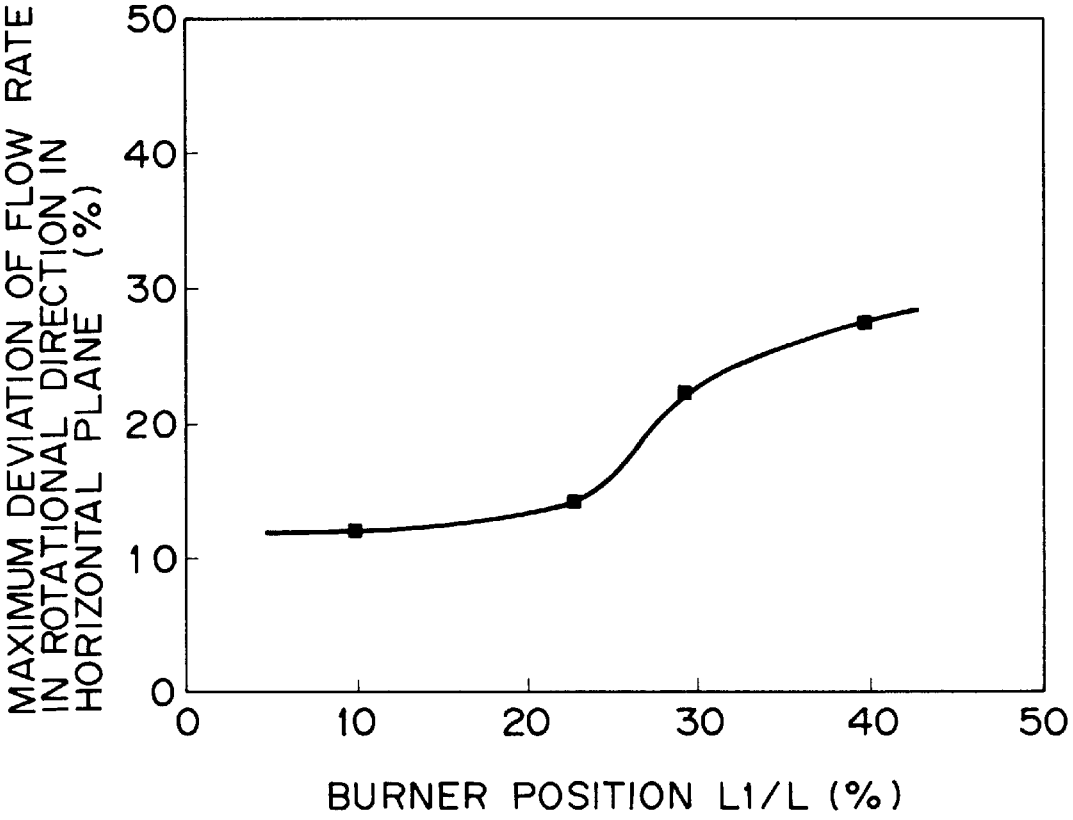
FIG. 2 is a diagram showing an effect of the burner arrangement of the first embodiment on the furnace performance.

In a diagram shown in FIG. 2, the abscissas represent a percentage of a ratio (L1/L) of the length L1 from the furnace corner 10 to the axis line 9 of the burner 6 to the length L of one side of width of the inside wall of the furnace 1, and the ordinates represent the maximum deviation from the average value of a flow rate component in the flow rate component distribution in the rotational direction in the horizontal plane of the flow rate components of combustion gas in the furnace, and the relationship between them is shown.

This figure shows that the maximum deviation from the average value of a component in the flow rate component distribution in the rotational direction in the horizontal plane of the flow rate components of combustion gas in the furnace changes depending on the ratio of length L1 to L. An increase in the maximum deviation means that the rotational component of combustion gas in the furnace is nonuniform accordingly, and suggests that a portion of low effectiveness is produced in a space in the furnace.

According to FIG. 2, the maximum deviation changes greatly at a portion here the ratio of L1 to L is about 25%. Therefore, it is found that by setting the ratio at a value less than 25%, for example, 15% as in this embodiment, the furnace effectiveness can be increased, and it is found that by setting the ratio at a value not less than 25% inversely, the effectiveness is decreased, so that the performance is lowered.

Thereupon, the burners 6 are arranged uniformly at one place on each of the furnace wall surfaces, the length L1 between the furnace corner 10 and the burner 6 is selected properly so that the ratio L1/L is less than 25%. Thereby, a problem of increased effectiveness of a space in a furnace interior 1*a* in the vicinity of the right side wall 4 or the left side wall 5 of the furnace 1, which has arisen in the prior art shown in FIG. 15, is solved, by which the whole furnace is used effectively, and therefore the combustion performance can be improved.

For the above reason, problems of the security of a space for maintenance and the compactness of the boiler as a whole, which have arisen in the prior art, can be solved, and the performance can be secured.

Thus, in this embodiment, the burners 6 are disposed on each of the furnace wall surfaces, not at the furnace corners 10, so that incidental facilities for the boiler 6 such as fuel piping is not disposed at the furnace corner 10. As a result, the concentration of equipment at four corners of boiler can be reduce, so that the space for maintenance of the burners 6 can be secured sufficiently. In addition, it is expected that the arrangement of steel frames for supporting the boiler has a degree of freedom, so that a compact boiler can be designed.

Next, the configuration of a combustion apparatus in accordance with a second embodiment of the present invention will be described with reference to the accompanying drawings.

Figure 3:
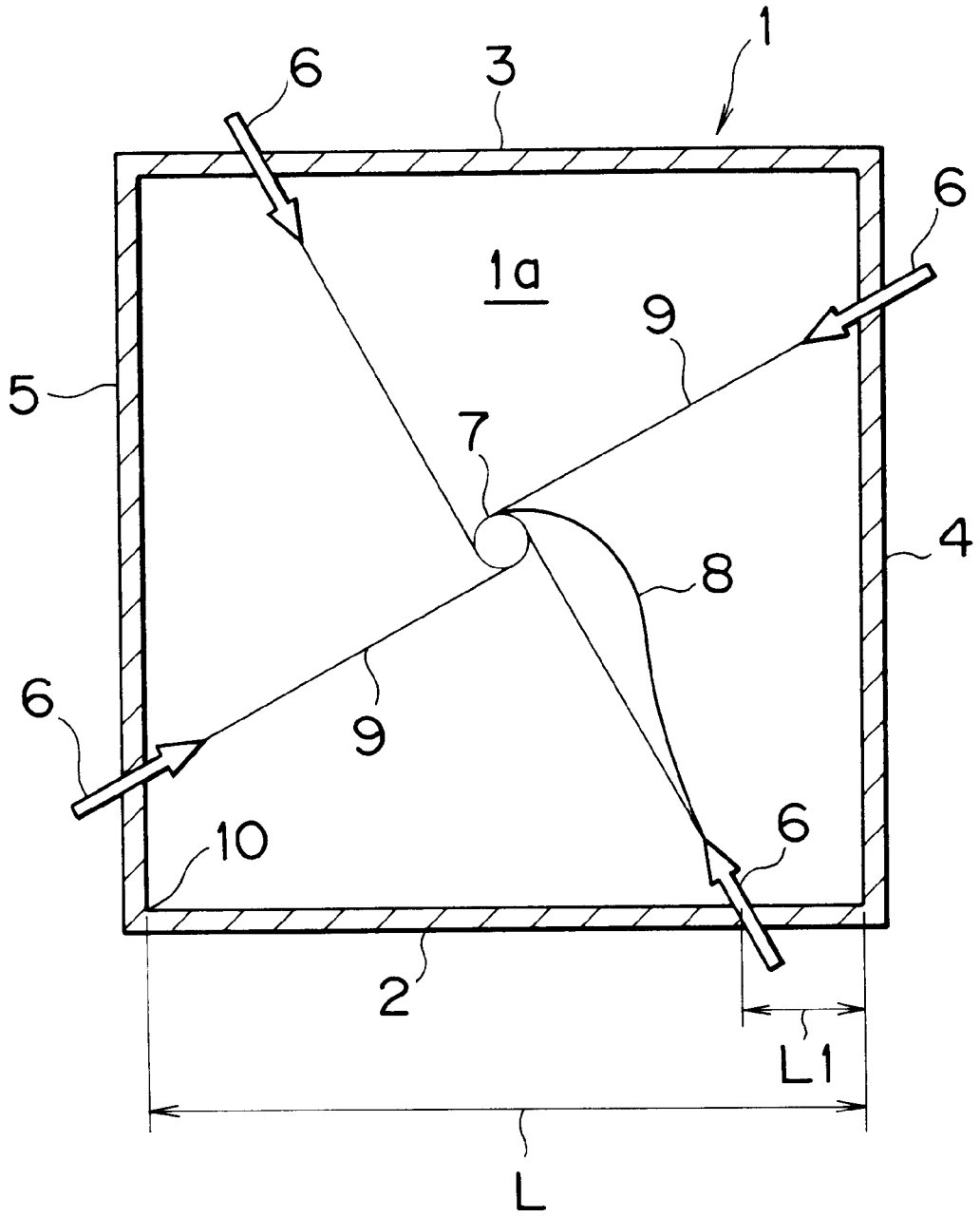
FIG. 3 is a schematic plan view showing a horizontal cross section of a boiler furnace using a combustion apparatus in accordance with a second embodiment of the present invention and the concept of a combustion flame in the cross section.

As shown in FIG. 3, in this embodiment as well, like the apparatus shown in FIG. 1, a furnace 1 having a square horizontal cross section is provided with burners 6 at one place on each of wall surfaces of a front wall 2, rear wall 3, right side wall 4, and left side wall 5 of the furnace 1. The burners 6 are disposed so that an axis line 9 of the burner 6 is tangent to an imaginary circle 7.

A length L1 from a furnace corner 10 to the axis line 9 of the burner 6 is set at a length of 15% of a length L of one side of width of the inside wall of the furnace 1 when the furnace 1 is viewed from the top.

This embodiment differs from the first embodiment in that the length L1 on each of the walls is measured in the clockwise direction from each of the furnace corners 10 in this embodiment while the length L1 on each of the walls is measured in the counterclockwise direction from each of the furnace corners 10 in the first embodiment.

The following is a description of the operation of the second embodiment of the present invention.

In this embodiment, the burner 6 is disposed apart from each of the furnace corners 10 by a length L1 in the counterclockwise direction. This embodiment is effective when the burners 6 cannot be disposed at the positions shown in FIG. 1 of the first embodiment because of the boiler construction.

Other effects are the same as those of the first embodiment. Specifically, the burners 6 are disposed on each of the furnace wall surfaces, not at the furnace corners 10, so that incidental facilities for the boiler 6 such as fuel piping is not disposed at the furnace corner 10. As a result, the concentration of equipment at four corners of boiler can be reduced, so that the space for maintenance of the burners 6 can be secured sufficiently. In addition, it is expected that the arrangement of steel frames for supporting the boiler has a degree of freedom, so that a compact boiler can be designed.

Also, the burners 6 are arranged uniformly at one place on each of the furnace wall surfaces, and the length L1 between the furnace corner 10 and the burner 6 is selected properly as in this embodiment. Thereby, a problem of increased effectiveness of a space in a furnace interior 1*a*in the vicinity of the right side wall 4 or the left side wall 5 of the furnace 1, which has arisen in the prior art shown in FIG. 15, is solved, by which the whole furnace is used effectively, and therefore the combustion performance can be improved.

For the above reason, problems of the security of a space for maintenance and the compactness of the boiler as a whole, which have arisen in the prior art, can be solved, and the performance can be secured.

Next, the configuration of a combustion apparatus in accordance with a third embodiment of the present invention will be described with reference to the accompanying drawings.

Figure 4:
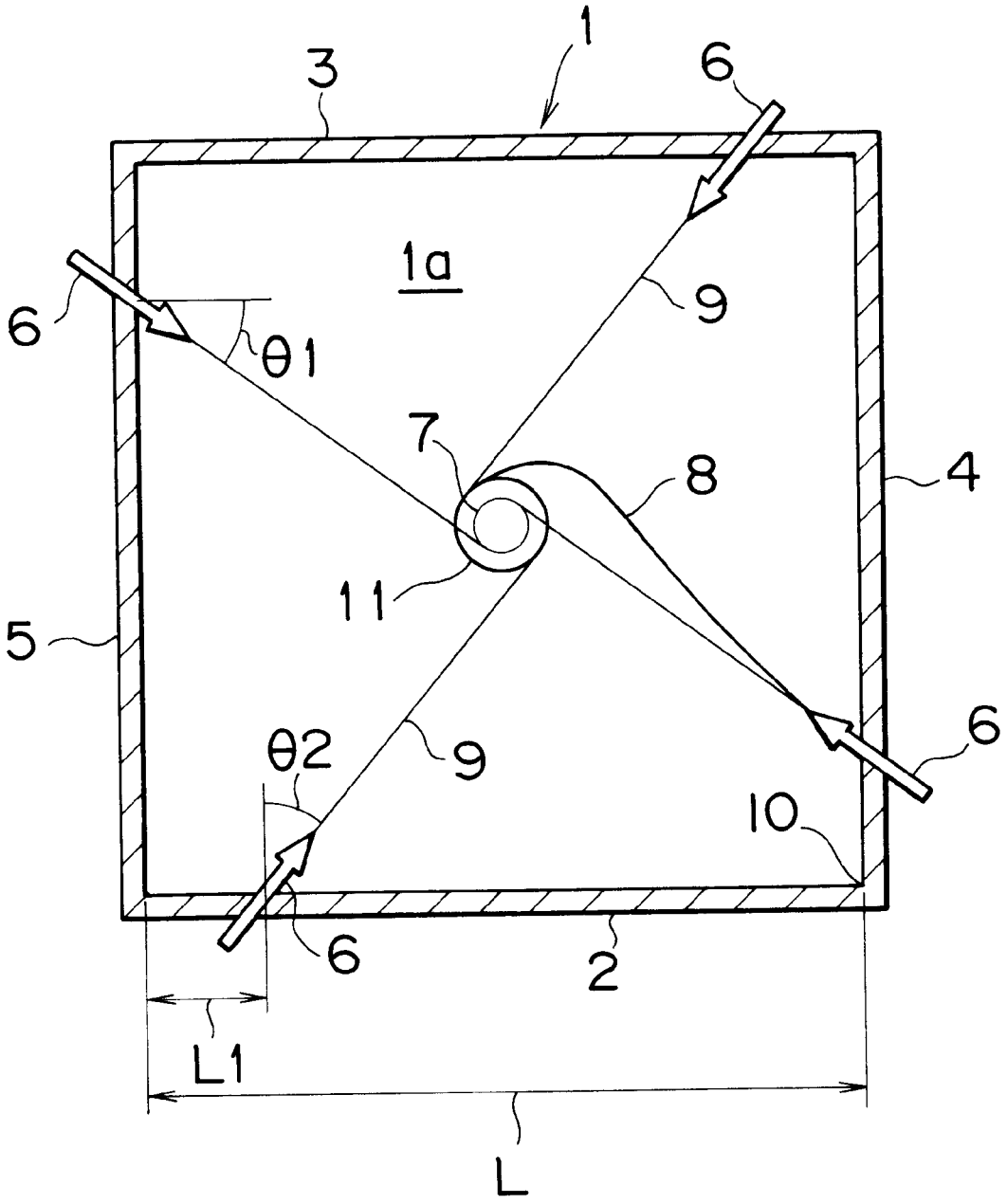
FIG. 4 is a schematic plan view showing a horizontal cross section of a boiler furnace using a combustion apparatus in accordance with a third embodiment of the present invention and the concept of a combustion flame in the cross section.

As shown in FIG. 4, like the first embodiment, a furnace 1 having a square horizontal cross section is provided with burners 6 at one place on each of wall surfaces of a front wall 2, rear wall 3, right side wall 4, and left side wall 5 of the furnace 1, at a total of four places.

This embodiment differs from the first embodiment in that a second imaginary circle 11 having a diameter different from that of an imaginary circle 7 is set concentrically with the imaginary circle 7. Specifically, the burners 6 on the right side wall 4 and the left side wall 5 of the furnace 1 are disposed so that in-furnace injection direction axis lines 9 thereof are tangent to the imaginary circle 7, and the burners 6 on the front wall 2 and the rear wall 3 of the furnace 1 are disposed so that axis lines 9 thereof are tangent to the imaginary circle 11.

A length L1 from a furnace corner 10 to the axis line 9 of the burner 6 is set at a length of, for example, 15% of a length L of one side of width of the inside wall of the furnace 1 when the furnace 1 is viewed from the top.

The following is a description of the operation of the third embodiment of the present invention.

In this embodiment, two imaginary circle 7 and 11 are provided in a furnace interior 1*a*. As shown in FIG. 4, the installation angles of the burners 6 are changed. Specifically, the installation angles of the burners 6 with respect to the right side wall 4 and the left side wall 5 of the furnace 1 are θ1, and the installation angles of the burners 6 with respect to the front wall 2 and the rear wall 3 of the furnace 1 are θ2. That is to say, the installation angles of the burners 6 with respect to the front wall 2 and the rear wall 3 of the furnace 1 are θ2 although the installation angles thereof are θ1 in the first embodiment, by which the degree of freedom of the arrangement of the burners 6 is increased as compared with the first embodiment, and the effective utilization of a space of the furnace interior 1*a* can be controlled more finely. Also, by changing the installation angle the burner 6, the direction of a burner panel and the like installed on the outside wall of the furnace 1 can be changed, so that the degree of freedom of the installation thereof is increased.

For the above reason, like the first embodiment, problems of the security of a space for maintenance and the compactness of the boiler as a whole, which have arisen in the prior art, can be solved, and the performance can be secured.

Next, the configuration of a combustion apparatus in accordance with a fourth embodiment of the present invention will be described with reference to the accompanying drawings.

Figure 5:
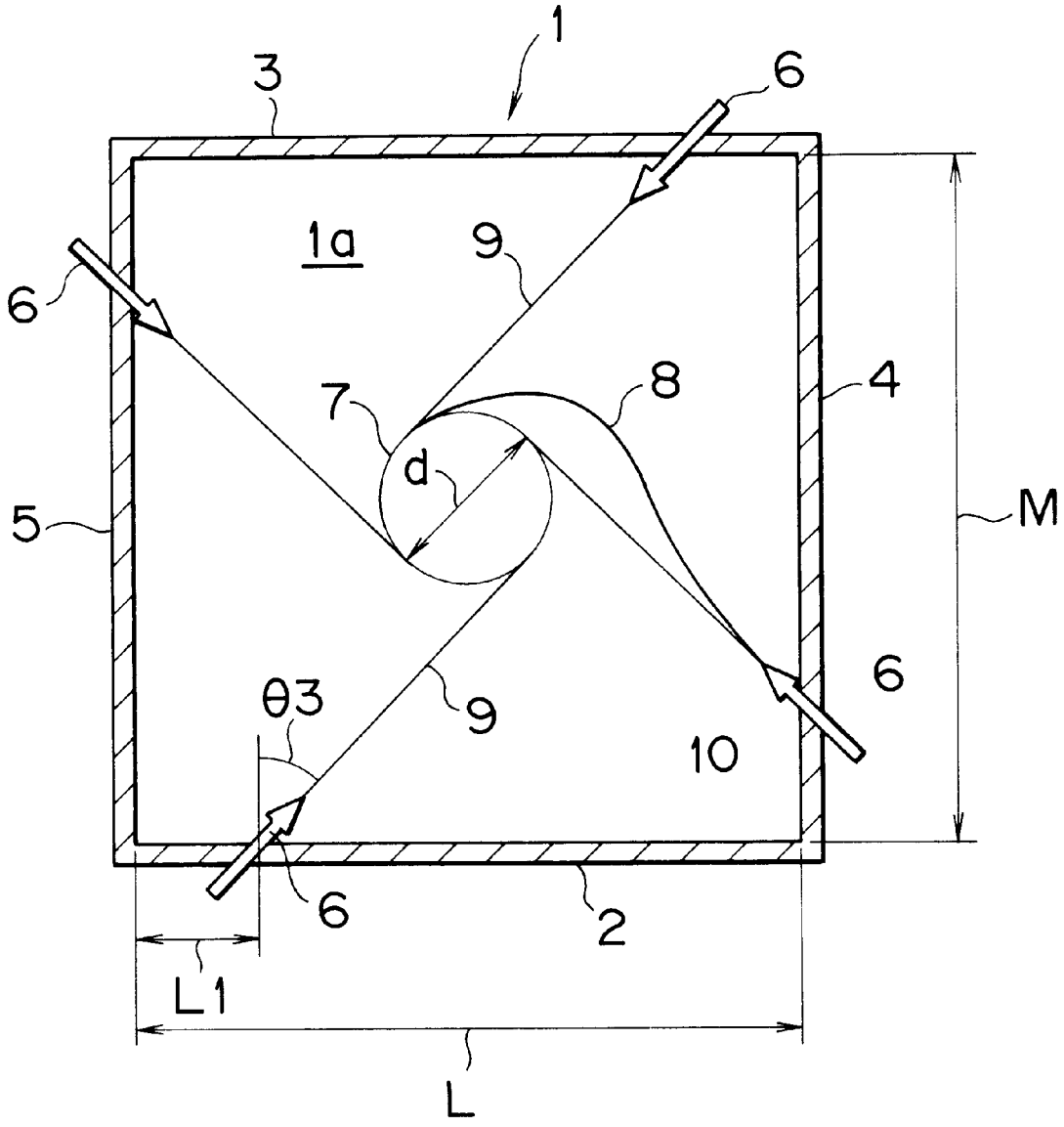
FIG. 5 is a schematic plan view showing a horizontal cross section of a boiler furnace using a combustion apparatus in accordance with a fourth embodiment of the present invention and the concept of a combustion flame in the cross section.

As shown in FIG. 5, in this embodiment as well, like the apparatus shown in FIG. 1, a furnace 1 having a square horizontal cross section is provided with burners 6 at one place on each of wall surfaces of a front wall 2, rear wall 3, right side wall 4, and left side wall 5 of the furnace 1. The burners 6 are disposed so that an in-furnace injection direction axis line 9 of the burner 6 is tangent to an imaginary circle 7. In this embodiment, the imaginary circle 7 has a diameter d. The value of the diameter d is increased so as to be 12.5% of the sum of a length L of the furnace width and a length M of the furnace depth (diameter of imaginary circle=(furnace width+furnace depth)×0.125).

A length L1 from a furnace corner 10 to the axis line 9 of the burner 6 is set at a length of 15% or so of the length L of one side of width of the inside wall of the furnace 1 when the furnace 1 is viewed from the top.

The following is a description of the operation of the fourth embodiment of the present invention.

Figure 6:
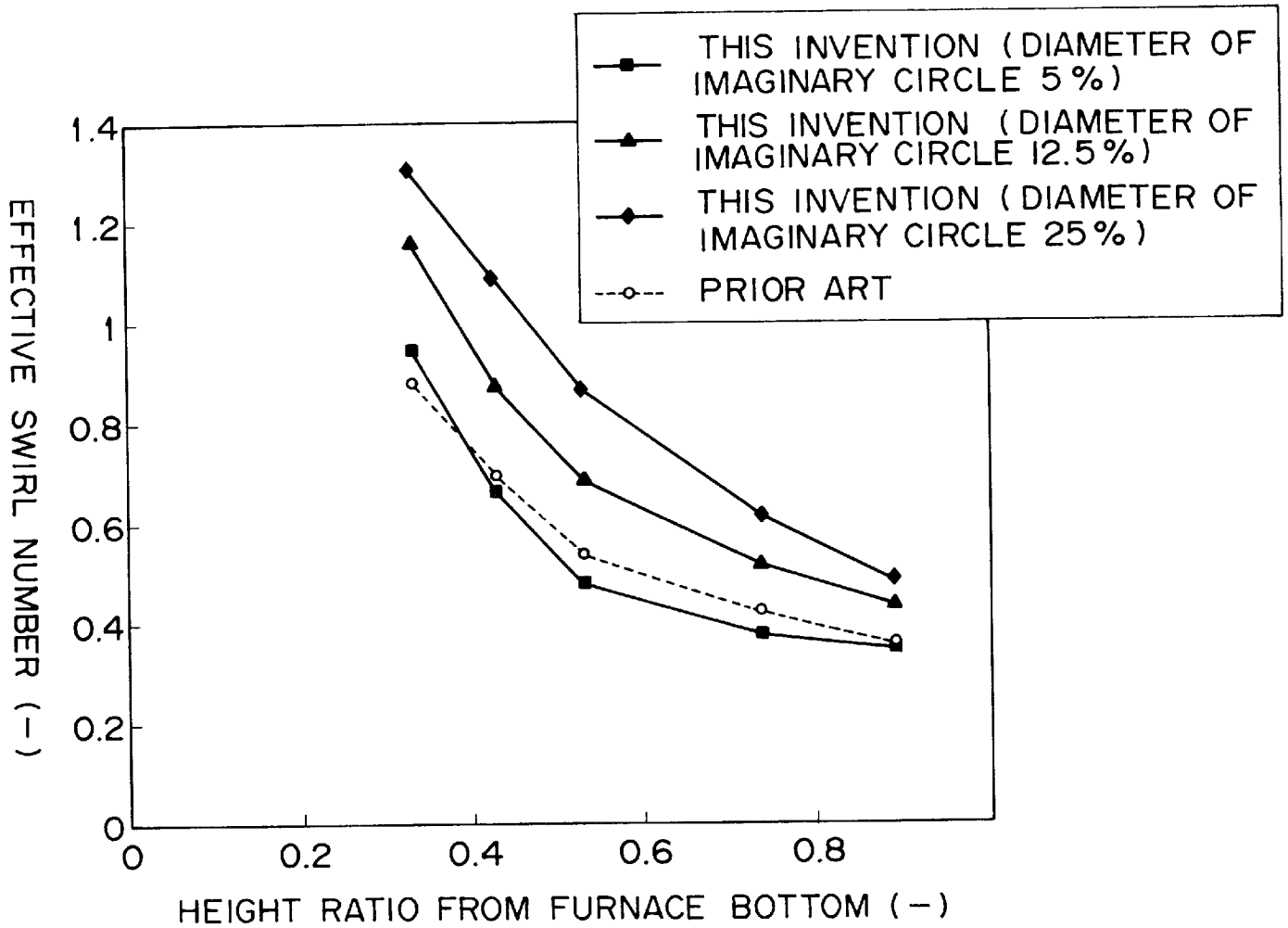
FIG. 6 is a diagram showing an effect of the burner arrangement of the fourth embodiment on the furnace performance.

In FIG. 6, the abscissas represent the height position of combustion gas generated in a furnace interior l*a* (height of combustion gas from the floor/total height of furnace interior), the ordinates represent the effective swirl number Swe of rotational combustion flame vortex generated in the furnace interior 1*a*, the diameter d of the imaginary circle 7 is a parameter, and the relationship between the three is shown.

Here, the effective swirl number Swe is an index obtained by integrating the ratio of the rotational component to the rising component of combustion gas element over the horizontal cross sectional area A of the furnace when for the flow rate produced when the combustion gas generated in the furnace interior 1*a* flows in the furnace interior 1*a*, the circumferential component of the imaginary circle 7, that is, the in-furnace rotational direction component is taken as Vθ, the in-furnace rising direction component is taken as Vz, the distance of a combustion gas element existing at a certain portion in the furnace interior 1*a* from the center of the imaginary circle is taken as r, and the hydrodynamic equivalent radius of the furnace is taken as R, and expressed by the following equation.

$$Swe = \frac{\int_A r \cdot V\theta \cdot |Vz| \cdot dA}{R \int_A Vz \cdot |Vz| \cdot dA}$$

That is to say, the effective swirl number Swe is an index showing a strength of rotation of combustion gas in a certain cross section in the furnace, and means that as the value of this index increases, the rotational force of combustion gas increases, that is, the rotational combustion flame vortex is formed stably.

In FIG. 6, three examples are shown in which the diameter d of the imaginary circle 7 has a length of 5%, 12.5%, and 25% of the sum of the half length of the furnace width L and the length of the furnace depth M (diameter of imaginary circle=(furnace width/2+furnace depth)×0.05, 0.125, and 0.25). This diagram indicates that as the diameter d increases, a larger effective swirl number Swe can be secured.

Also, according to the present invention, it is found that in order to form a rotational combustion flame vortex as stably as or more stably than the prior art, the diameter d of the imaginary circle 7 must be larger at least than a length exceeding 5% of the sum of the length of the furnace width L and the length of the furnace depth M (diameter of imaginary circle>(furnace width+furnace depth)×0.05).

For the above reason, in the present invention, the set angle θ3 of the burner 6 can be set so that the whole boiler is not made large, in the range of the diameter d of the imaginary circle 7, while stably forming the rotational combustion flame vortex, that is, while sufficiently securing the combustion performance. Therefore, the degree of freedom of the arrangement of the burners 6 can be increased, so that a problem of compactness of the boiler as a whole, which has arisen in the prior art, can be solved.

By the above-described operation, like the first embodiment, problems of the security of a space for maintenance and the compactness of the boiler as a whole, which have arisen in the prior art, can be solved, and the performance can be secured. Further, by making the optimum selection considering the interaction between the diameter of the imaginary circle 7 and the arrangement of the burners 6, the effect of further increased performance can be expected.

Next, the configuration of a combustion apparatus in accordance with a fifth embodiment of the present invention will be described with reference to the accompanying drawings.

Figure 7:
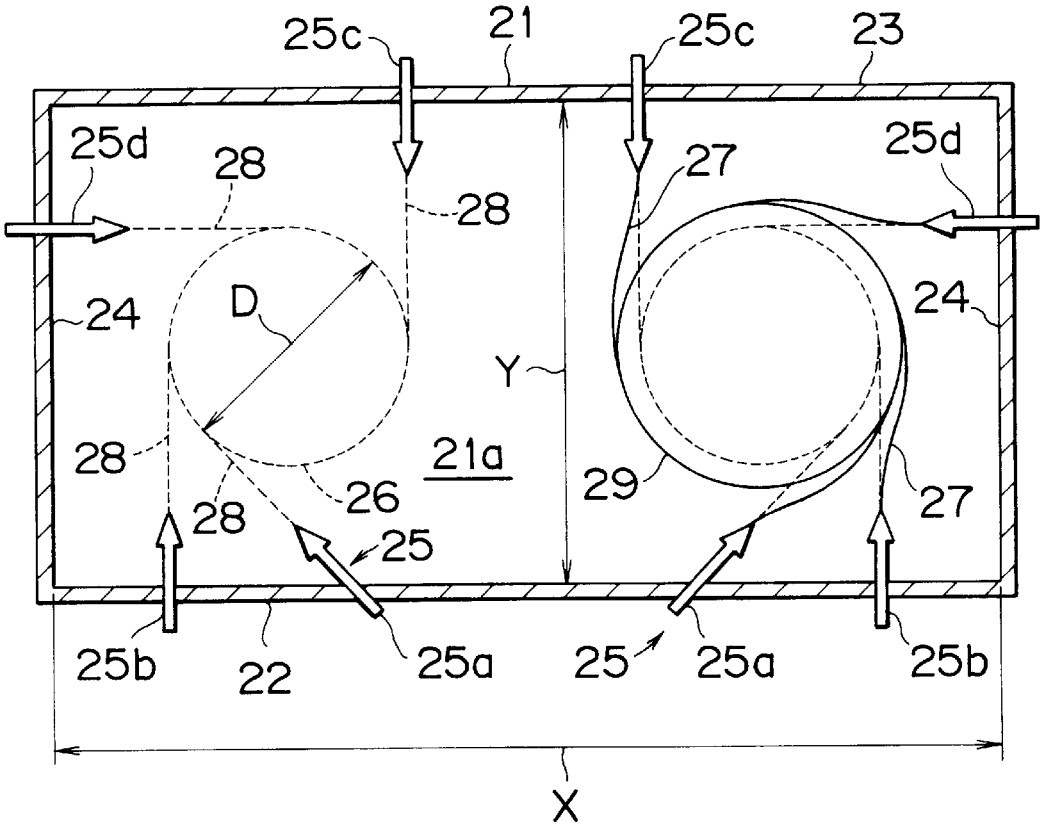
FIG. 7 is a schematic plan view showing a horizontal cross section of a boiler furnace using a combustion apparatus in accordance with a fifth embodiment of the present invention and the concept of a combustion flame in the cross section.

FIG. 7 shows a furnace 21 using the combustion apparatus in accordance with the present invention. As shown in this figure, the rectangular furnace 21 is provided with burners 25 so that the axis line thereof is tangent to two imaginary circles 26 having a different center position.

On a front wall 22 of the furnace 21, burners 25*a* are disposed at two places at the center and burners 25*b* are disposed at two places on the outer side. Burners 25*c* are disposed at two places on a rear wall 23, and burners 25*d* are disposed at two places on side walls 24. The axis lines of a set of four burners 25*a* to 25*d* are tangent to one imaginary circle 26. Two sets of burners 25*a* to 25*d* at four places in one set are disposed in symmetry in a furnace interior 21*a*.

Figure 16:
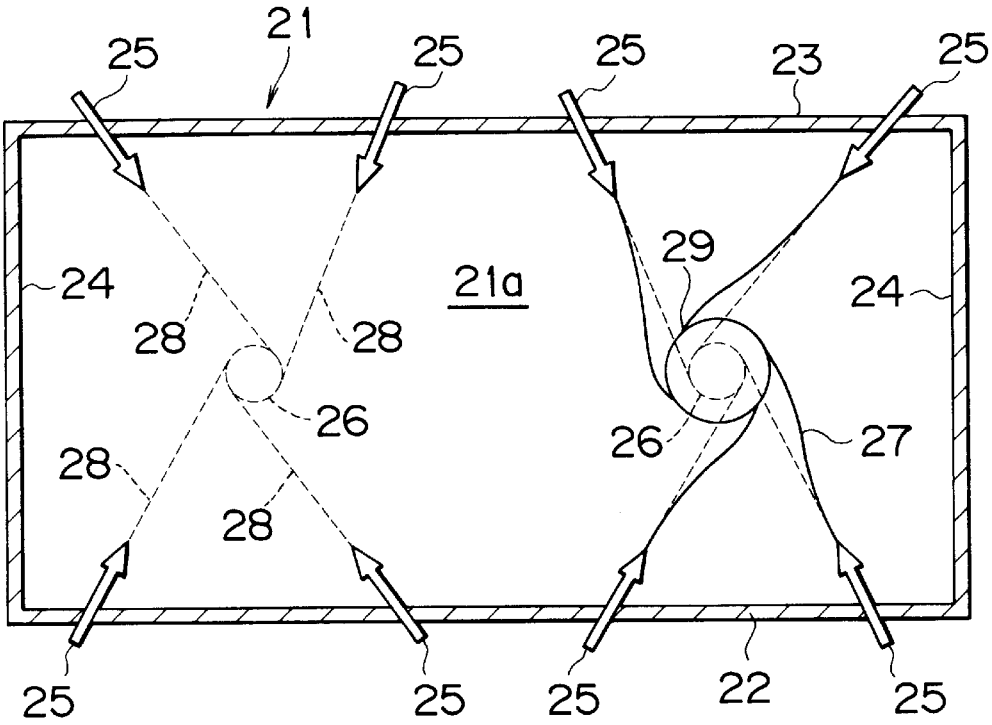
FIG. 16 RELATED ART
FIG. 16 is a schematic plan view showing a horizontal cross section of a conventional boiler furnace using a rotational combustion system of the prior art and the concept of a combustion flame in the cross section.

The furnace 21 of this embodiment differs from the furnace described in the conventional example shown in FIG. 16 mainly in that the number of burners 25 disposed on the rear wall 23 of the furnace 21 is decreased from four to two and the burners 25*d* are disposed on each of the side walls 24 on the side of the rear wall 23, and in that the diameter D of the imaginary circle 26 in the furnace interior 21*a* is increased. With the increase in the diameter D of the imaginary circle 26, both of the two burners disposed at the center of the front wall 22 are disposed by being shifted to the outside. That is to say, the distance between the burners 25*a* and 25*a* is increased.

In this embodiment, the diameter D of the imaginary circle 26 has a length of 25% of the sum of the half length of furnace width and the length of furnace depth (diameter of imaginary circle=(furnace width/2+furnace depth)×0.25), so that the diameter D is larger than that of the conventional furnace.

The following is a description of the operation of the fifth embodiment of the present invention.

As shown in FIG. 7, of the burners 25, two burners are disposed on the side wall 24 of the furnace 21 as indicated by 25*d*. As a result, the number of the burners 25 disposed in a limited space near the outside of the rear wall 23 is decreased from four to two. By this operation, near the outside of the rear wall 23, a space occupied by an air duct for supplying combustion air to the burners 25 can be reduced, and at the same time, the number of the installation places of the burners themselves is decreased, so that a sufficient space can be secured.

Figure 8:
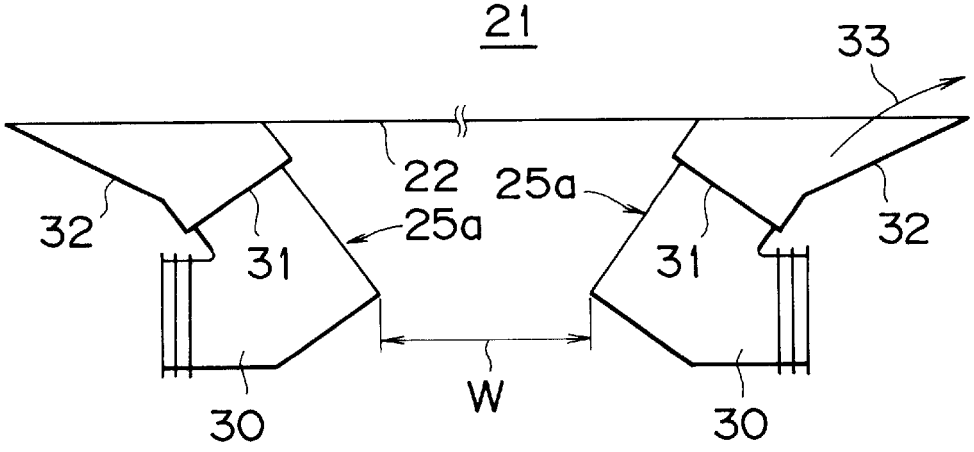
FIG. 8 is an enlarged view of burners disposed on the front wall of the boiler furnace shown in FIG. 7.

Also, in this embodiment, as compared with the prior art, the diameter D of the imaginary circle 26 is set to have a length of 25% of the sum of the half length of the furnace width X and the length of the furnace depth Y, and it is considered that a rotational combustion flame vortex 29 can be formed stably by the interaction with the arrangement of the burners 25 including the burners 25*d* disposed on the side walls. Thereby, as is seen from the relationship between FIG. 8 and FIG. 17, a long distance W between burner wind boxes 30 and 30 disposed at two places near the center of the front wall 22 can be secured.

Figure 9:
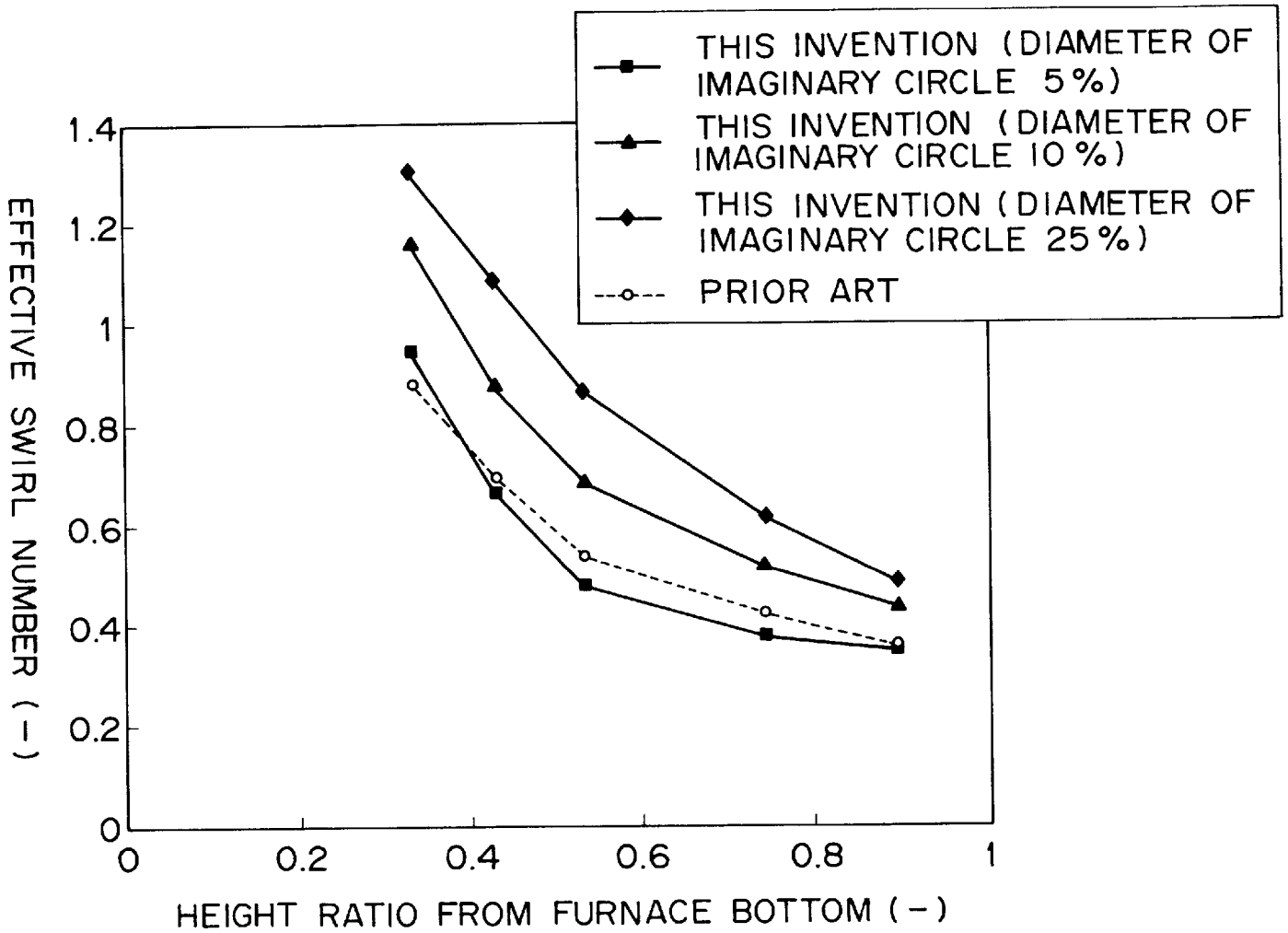
FIG. 9 is a diagram showing an effect of the diameter of an imaginary circle of the fifth embodiment on the performance of rotational combustion flame vortex.

In FIG. 9, the abscissas represent the height position of combustion gas generated in a furnace interior 21*a* (height of combustion gas from the floor/total height of furnace interior), the ordinates represent the effective swirl number Swe of rotational combustion flame vortex 29 generated in the furnace interior 21*a*, the diameter D of the imaginary circle 26 is a parameter, and the relationship between the three is shown.

FIG. 9 shows three examples in which the diameter D of the imaginary circle 26 has a length of 5%, 10%, and 25% of the sum of the half length of the furnace width X and the furnace depth Y (diameter of imaginary circle=(furnace width/2+furnace depth)×0.05, 0.10 and 0.25). This diagram indicates that as the diameter D increases, a larger effective swirl number Swe can be secured.

Also, according to the present invention, it is found that in order to form the rotational combustion flame vortex 29 as stably as or more stably than the prior art, the diameter D of the imaginary circle 26 must be larger at least than a length exceeding 5% of the sum of the half length of the furnace width X and the length of the furnace depth Y (diameter of imaginary circle>(furnace width/2+furnace depth)×0.05).

For the above reason, in the present invention, the degree of freedom of the arrangement of the burners 25 can be increased while stably forming the rotational combustion flame vortex 29, that is, while sufficiently securing the combustion performance. As a result, a problem of compactness of the boiler as a whole, which has arisen in the prior art, can be solved without increasing the size of boiler unnecessarily to provide a space for maintenance.

Next, the configuration of a combustion apparatus in accordance with a sixth embodiment of the present invention will be described.

Figure 10:
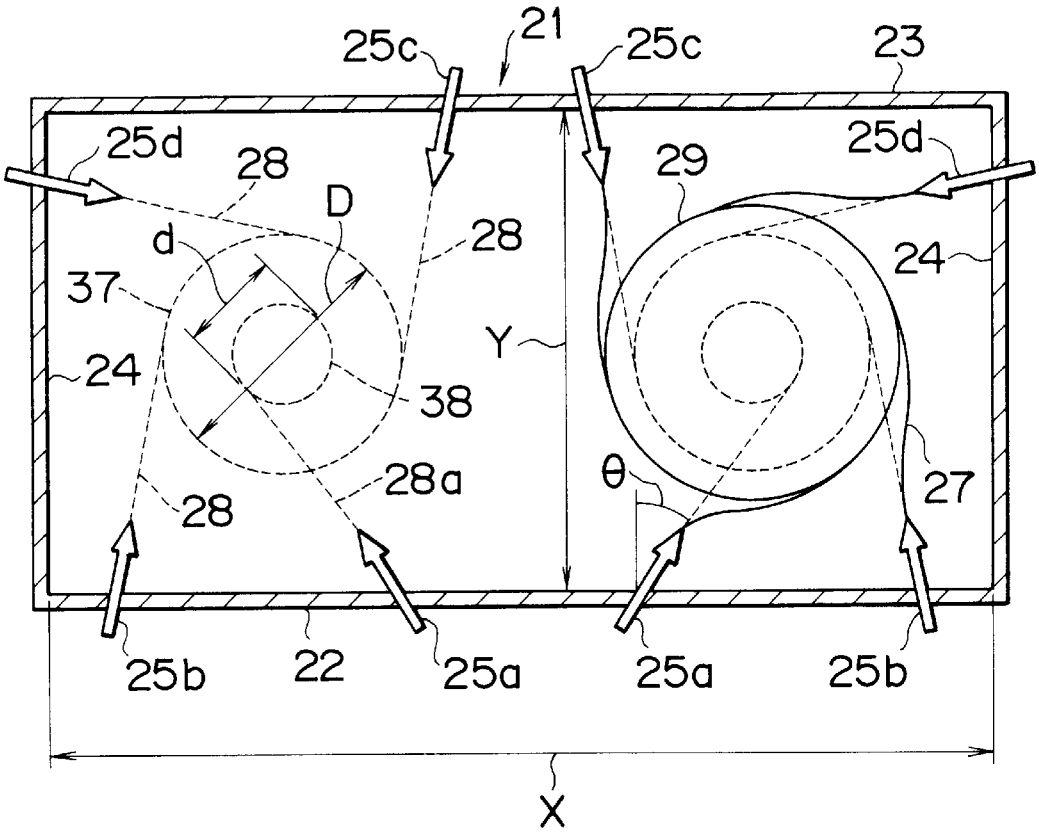
FIG. 10 is a schematic plan view showing a horizontal cross section of a boiler furnace using a combustion apparatus in accordance with a sixth embodiment of the present invention and the concept of a combustion flame in the cross section.

As shown in FIG. 10, eight arrangement locations of burners 25*a* to 25*d* of a furnace 21 are provided on the same walls 22 to 24 so as to correspond to the fifth embodiment. Therefore, in this embodiment as well, unlike the prior art shown in FIG. 16, two burners 25*d* of the eight burners 25 are disposed on side walls 24 of the furnace 21.

This embodiment differs from the fifth embodiment in that two imaginary circles having a different diameter are provided in a furnace interior 21*a*. Of these imaginary circles, the diameter D of a first imaginary circle 37 on the outside is set to have a length of 25% of the sum of the half length of the furnace width X and the length of the furnace depth Y (diameter of imaginary circle=(furnace width/2+furnace depth)×0.25), so that the diameter D is larger than that of the conventional furnace. On the inside of the first imaginary circle 37, a second imaginary circle 38 having a diameter different from that of the first imaginary circle 37 is set. These two imaginary circles, the first imaginary circle 37 and the second imaginary circle 38, are imagined concentrically, and are provided at two places in the furnace interior 21*a*.

Of the burners 25 disposed at eight places, six burners 25*b* to 25*d* disposed on the outer side of the front wall 22, the side walls 24, and the rear wall 23 of the furnace 21 are arranged so that an in-furnace injection direction axis line 28 of fuel and combustion air injected from the burner is tangent to the first imaginary circle 37. Also, the burners 25*a* disposed at two places near the center of the front wall 22 are arranged so that an axis line 28*a* of fuel and combustion air injected from the burner is tangent to the second imaginary circle 38.

The following is a description of the operation of the sixth embodiment of the present invention.

As compared with the fifth embodiment shown in FIG. 7, in this embodiment, of the eight burners 25 shown in FIG. 10, the burners 25*a* disposed at two places at the center of the front wall 22 of the furnace 21 inject fuel and combustion air toward the axis direction of the second imaginary circle 38 unlike the burners 25*b* to 25*d* disposed at other six places.

The stable formation of the rotational combustion flame vortex 29 in the furnace interior 21*a* is less disturbed by the burners 25*a*. Therefore, the general situation is governed by the effect of the burners 25*b* to 25*d* disposed by other six places, so that a sufficiently stable rotational combustion flame vortex 29 can be secured.

Figure 11:
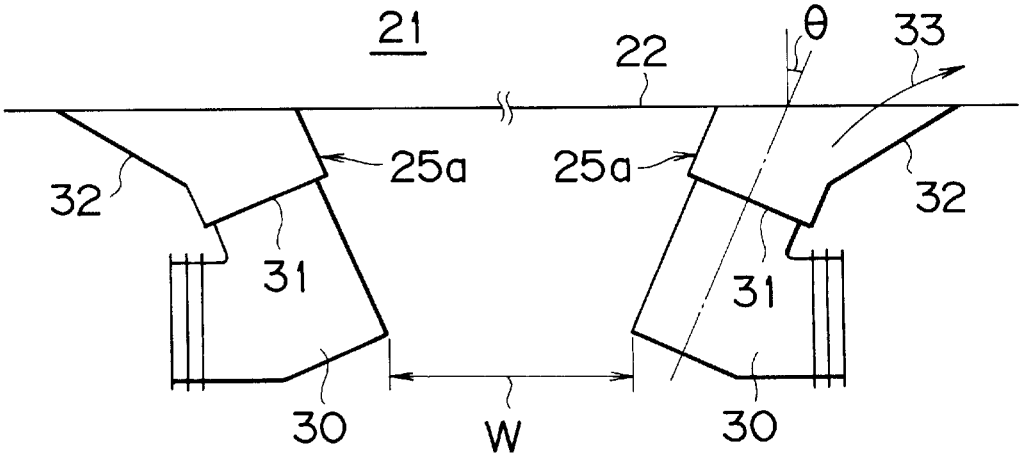
FIG. 11 is an enlarged view of burners disposed on the front wall of the boiler furnace shown in FIG. 10.

Also, for this reason, the in-furnace injection direction θ of the fuel and combustion air injected from the burner 25*a* can be selected with a relatively high degree of freedom as compared with the prior art. As a result, as shown in FIG. 11, as in the case of the fifth embodiment, a long distance W between the burners 25*a* or wind boxes 30 disposed at two places near the center of the front wall 22 of the furnace 21 can be secured.

Further, the relationship between the angle of the in-furnace injection direction axis line 28*a* of fuel and combustion air injected from the burner 25*a* at the center of the front wall 22 of the furnace 21 and the diameter d of the second imaginary circle 28 can be selected by appropriate adjustment. Thereupon, the size of a burner panel 32 can be decreased, and therefore the disturbance of stable formation of the rotational combustion flame vortex 29 given by combustion gas 33 flowing along the inside wall surface of the burner panel 32 can be reduced to the utmost.

For the above reason, the degree of freedom of arrangement of the burners 25 can be increased further while stably forming the rotational combustion flame vortex 29. As a result, problems of the security of performance of the furnace 21, the security of a space for maintenance, and the compactness of the boiler as a whole, which have arisen in the prior art, can be solved.

Next, the configuration of a combustion apparatus in accordance with a seventh embodiment of the present invention will be described.

Figure 12:
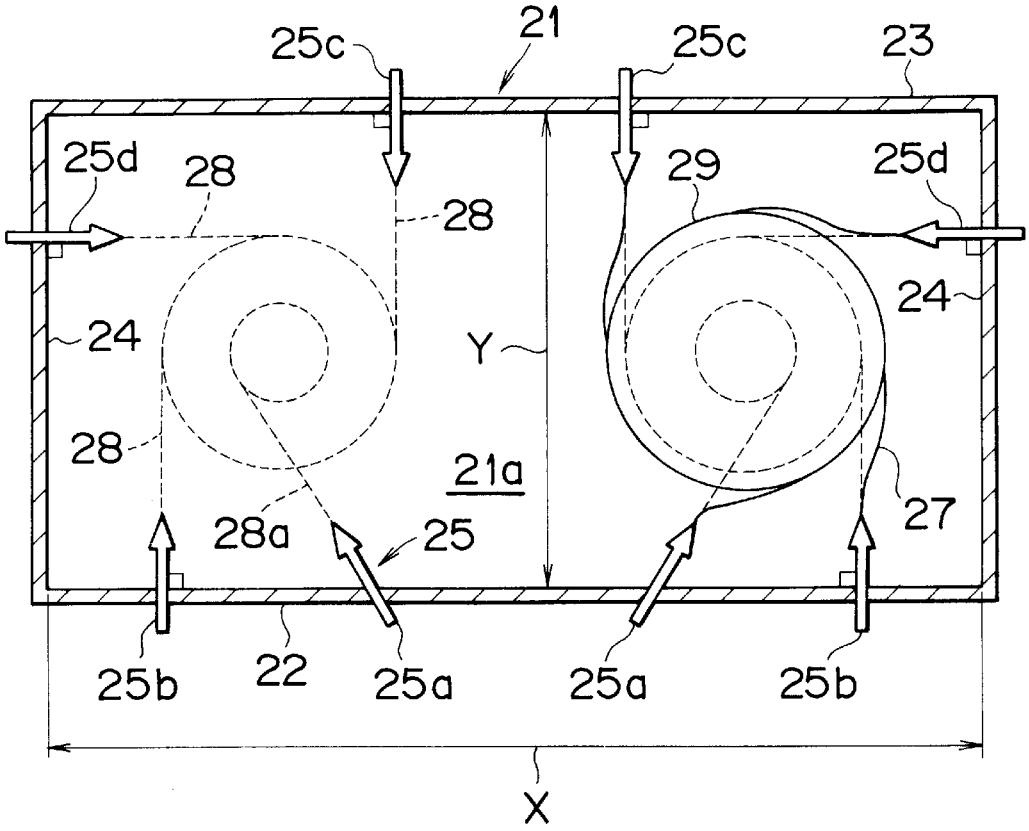
FIG. 12 is a schematic plan view showing a horizontal cross section of a boiler furnace using a combustion apparatus in accordance with a seventh embodiment of the present invention and the concept of a combustion flame in the cross section.

As shown in FIG. 12, burners 25*a* to 25*d* of a furnace 21 are disposed on the same walls 22 to 24 so as to correspond to the fifth embodiment. Therefore, in this embodiment as well, unlike the prior art shown in FIG. 16, the two burners 25*d* of the burners 25 disposed at eight places are disposed on the side walls 24 of the furnace 21.

Of the burners 25 disposed at eight places, six burners 25*b* to 25*d* disposed on the outer side of the front wall 22, the side walls 24, and the rear wall 23 of the furnace 21 are arranged so that an in-furnace injection direction axis line 28 of fuel and combustion air injected from the burner is tangent to a first imaginary circle 37. Also, these six burners 25*b* to 25*d* are disposed so that the axis line 28 of fuel and combustion air injected from the burners 25*b* to 25*d* is at right angles to the wall surface of the furnace 21.

The burners 25*a* disposed at two places near the center of the front wall 22 of the furnace 21 are arranged so that an axis line 28*a* of fuel and combustion air injected from the burner is tangent to a second imaginary circle 38.

The diameter D of a first imaginary circle 37 is set to have a length of 25% of the sum of the half length of the furnace width X and the length of the furnace depth Y (diameter of imaginary circle=(furnace width/2+furnace depth)×0.25), so that the diameter D is larger than that of the conventional furnace. The second imaginary circle 38 on the inside of the first imaginary circle 37 has a diameter smaller than the diameter of the first imaginary circle 37.

The following is a description of the operation of the seventh embodiment of the present invention.

Figure 13:
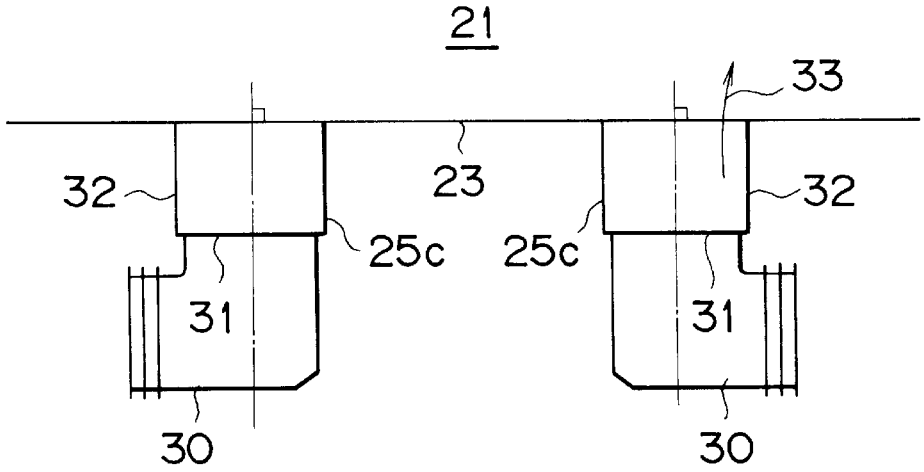
FIG. 13 is an enlarged view of burners disposed on the furnace rear wall turned by 180 degrees from FIG. 11, with the furnace rear wall side being the lower side of the figure and the furnace front wall side being the upper side of the figure.
Figure 17:
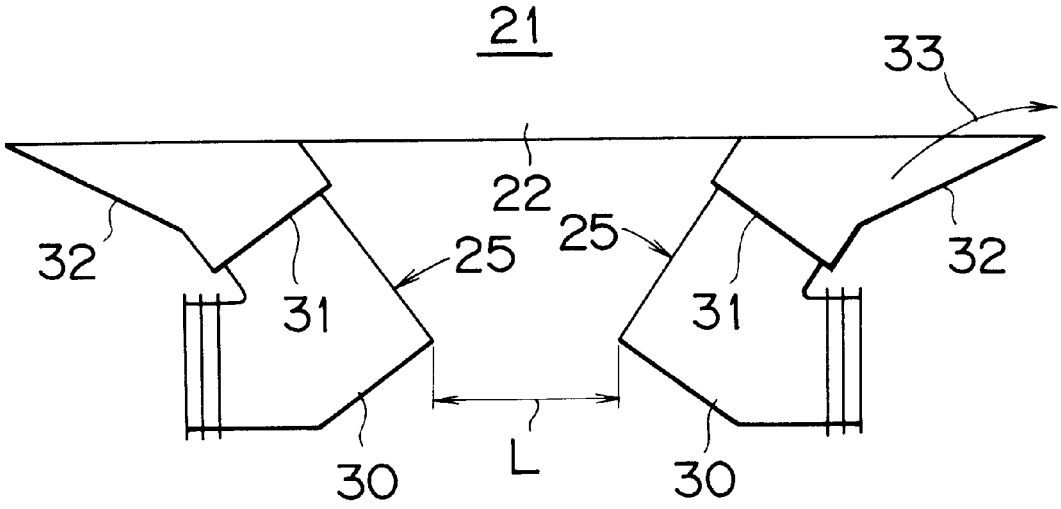
FIG. 17 RELATED ART
FIG. 17 is an enlarged view of burners disposed on the front wall of the boiler furnace shown in FIG. 15.
Figure 18:
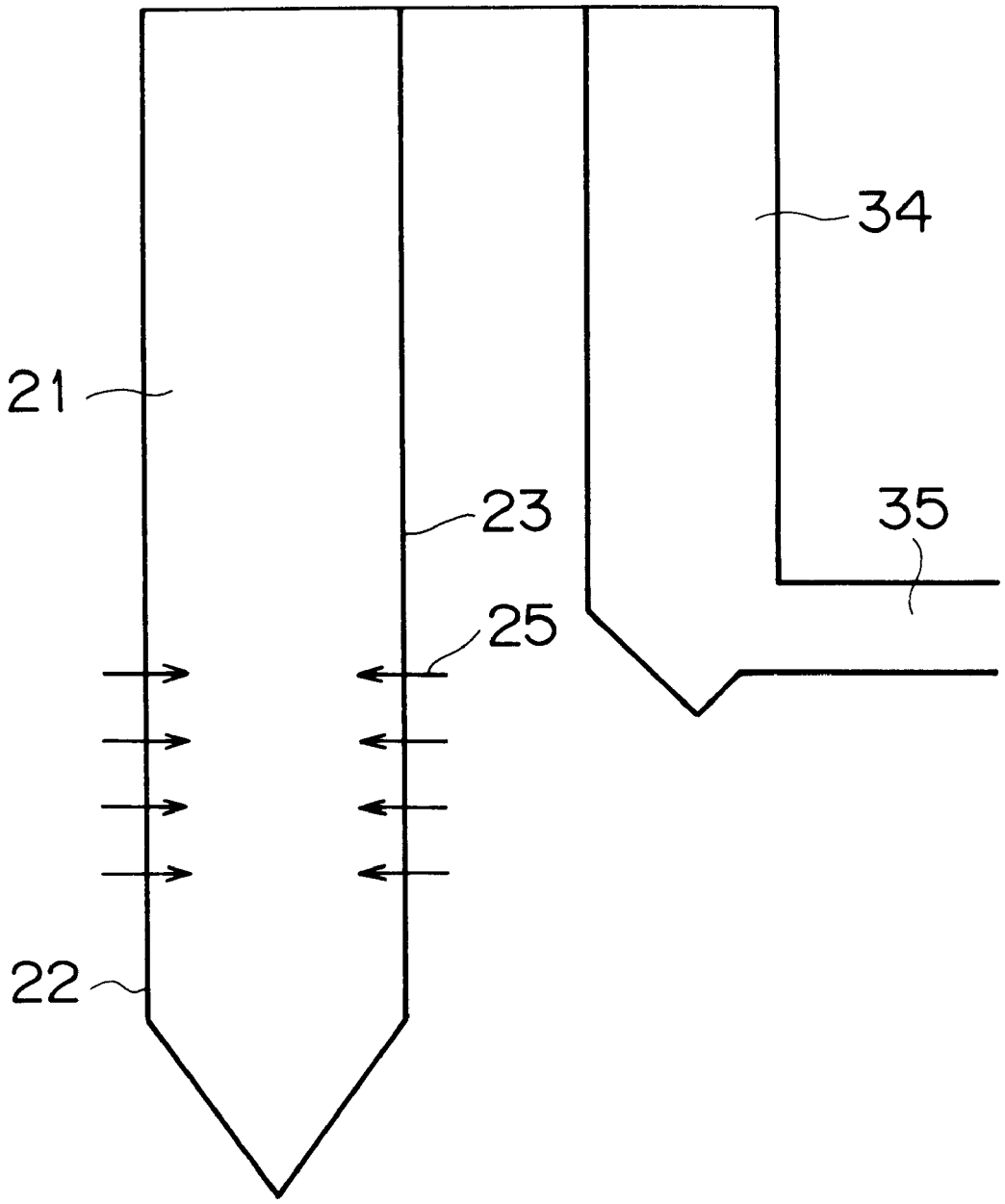
FIG. 18 RELATED ART
FIG. 18 is a schematic view showing the side of a boiler.

FIG. 17 shows the two burners 25 disposed near the center of the front wall 22 of the furnace 21, and FIG. 13 shows the two burners 25*c* disposed near the center of the rear wall 23 thereof. There is no basic difference in configuration between the two burners 25 disposed near the center of the front wall 22 and the two burners 25*c* disposed near the center of the rear wall 23 except that the burners 25 shown in FIG. 17 is in accordance with the prior art while the burners 25*c* shown in FIG. 13 have a new operation based on the present invention.

However, according to the present invention, since the axis lines 28 of the plural burners 25*b* to 25*d* are disposed at right angles to the wall surface of the furnace 21 as described above, as is seen from the comparison of FIG. 13 and FIG. 17, for the burner 25*c* in FIG. 13, the occupied space of a wind box 30 thereof can be minimized, so that an excess material required in the prior art can be reduced. This effect is not achieved by only the two burners 25*c* disposed near the center of the rear wall 23, but can be achieved by the six burners 25*b* to 25*d*, the axis lines of which are disposed at right angles to the wall surface of the furnace 21, including the two burners 25*b* disposed on the outer side of the front wall 22, the two burners 25*c* disposed on the rear wall 23, and the two burners 25*d* disposed on the side walls.

Further, according to the present invention, the size of a burner panel 32 can also be minimized. Thereby, the disturbance of stable formation of the rotational combustion flame vortex 29 given by combustion gas 33 flowing along the inside wall surface of the burner panel 32 can be reduced to the utmost.

For the above reason, problems of the security of performance of the furnace 21, the security of a space for maintenance, and the compactness of the boiler as a whole, which have arisen in the prior art, can be solved.

The embodiments of the present invention have been described above. Needless to say, the present invention is not limited to these embodiments, but can be modified variously based on the technical concept of the present invention.

For example, although two imaginary circles having a different center position are provided in the furnace interior 1*a*, 21*a* in the above-mentioned embodiments, three or more imaginary circles may be provided.

As described above, according to the present invention, the burners are disposed on all of the walls of the furnace, and the injection direction axis line of the burner is arranged at a distance less than 25% of the length of one side of width of the furnace inside wall on which the burner is disposed from the end of the furnace inside wall when the furnace is viewed from the top. Therefore, the burners can be disposed on the wall surfaces of furnace, not at the corners of furnace. As a result, the concentration of equipment at four corners of boiler can be reduce, so that the space for maintenance of the burners can be secured sufficiently. Also, the space in the furnace in the vicinity of the left side wall of the furnace can be utilized effectively, and the combustion performance can be improved by effectively using the whole furnace.

Also, the burners are disposed on all of the walls of the furnace, the injection direction axis line of the burner is arranged at a distance of less than 25% of the length of the furnace inside wall from the end of the furnace inside wall when the furnace is viewed from the top, and at least one or more burners are disposed so that the injection direction axis line of the burner or the extension line thereof is tangent to one or more second imaginary circles provided concentrically with the aforesaid imaginary circle. Therefore, the degree of freedom of the arrangement of burners is increased further, so that the effective utilization of the space in the furnace can be controlled more finely.

Also, since the diameter of the imaginary circle has a length exceeding 5% of the sum of the length of the furnace width and the length of the furnace depth (diameter of imaginary circle>(furnace width+furnace depth)×0.05), the degree of freedom of the arrangement of burners can be increased while stably forming the rotational combustion flame vortex.

As described above, although the plural burners are disposed on only one pair of opposed walls of the furnace having a rectangular cross section in the prior art, at least one or more burners are disposed on the other pair of opposed walls of the furnace in the present invention. Therefore, the number of the burners disposed on one pair of opposed walls can be reduced. Thereby, a space is produced on one pair of the walls, so that maintenance can be performed easily.

Also, if the diameter of the imaginary circle is set to have a length exceeding 5% of the sum of the half length of the furnace width and the length of the furnace depth (diameter of imaginary circle>(furnace width/2+furnace depth)×0.05), the rotational combustion flame vortex can be formed stably.

Further, if the injection direction axis line or the extension line thereof of either or both of the fuel and combustion air injected from at least one or more burners is set to be tangent to the second imaginary circle set in the aforesaid imaginary circle, the degree of freedom of the installation of burner whose injection direction axis line is directed to the second imaginary circle is improved while the stability of rotational combustion flame vortex is maintained.

Still further, if the burner is disposed so that the injection direction axis line or the extension line thereof of either or both of the fuel and combustion air injected from at least one or more burners is set to be at right angles to the furnace wall surface on which the burner is disposed, the occupied space of the burner wind box can be minimized.

The entire disclosure of Japanese Patent Application No. 9-302652 filed on Nov. 5, 1997 including specification, claims drawings and summary are incorporated herein by reference in its entirety.

The entire disclosure of Japanese Patent Application No. 9-302653 filed on Nov. 5, 1997 including specification, claims drawings and summary are incorporated herein by reference in its entirety.

What is claimed is:

1. A combustion apparatus comprising a furnace including four walls, each having an inside length, joined to form a rectangular transverse cross section, and a plurality of burners for forming a flame disposed on the walls of the furnace so that each burner injects fuel into the furnace along an injection direction axis line, the burners being oriented such that all of the injection direction axis lines are tangent to an imaginary circle located in the furnace, and wherein at least one of the burners is disposed on each of the four walls of the furnace so that the injection direction axis line of each said burner on said walls intersects the inside surface of the wall on which the burner is disposed, at a location spaced from an inside end of the wall, and wherein the distance between said inside end of the wall and said location spaced from said inside end of the wall is less than 25% of the inside length of the wall.

2. A combustion apparatus according to claim 1, wherein the imaginary circle has a diameter exceeding 5% of the sum of an inside width of the furnace and an inside depth of the furnace.

3. A combustion apparatus comprising a furnace including four walls, each having an inside length, joined to form a square transverse cross section, and a plurality of burners for forming a flame disposed on the walls of the furnace so that each burner injects fuel into the furnace along an injection direction axis line, the burners being oriented such that each of the injection direction axis lines is tangent to a corresponding imaginary circle located in the furnace, and wherein at least one of the burners is disposed on each of the four walls of the furnace so that the injection direction axis line of each said burner on said walls intersects the wall on which the burner is disposed at a location spaced from an inside end of the wall and wherein the distance between said inside end of the wall and said location spaced from said inside end of the wall is less than 25% of the inside length of the wall, and wherein at least one burner is disposed so that the injection direction axis line of the burner is tangent to a first corresponding imaginary circle that is different from, and concentric with, the corresponding imaginary circle to which the injection direction axis line of a different one of said burners is tangent.

4. A combustion apparatus according to claim 2, wherein the first corresponding imaginary circle has a diameter exceeding 5% of the sum of an inside width of the furnace and an inside depth of the furnace.

5. A combustion apparatus comprising a furnace including two pairs of opposed walls joined to form a rectangular transverse cross section, and a plurality of burners for forming a flame disposed on one pair of opposed walls of the furnace so that the injection direction axis line of each burner injects fuel into the furnace along an injection direction axis line which is tangent to a corresponding imaginary circle set in the furnace, and wherein at least one or more additional burners are disposed on the other pair of opposed walls of the furnace and are oriented such that the injection direction axis line of each said additional burner is tangent to a corresponding imaginary circle located in the furnace and wherein said corresponding imaginary circles of said axis lines of said burners and said additional burners comprise at least two corresponding imaginary circles having corresponding centers spaced from each other.

6. A combustion apparatus according to claim 5, wherein at least one of said imaginary circles has a diameter exceeding 5% of the sum of an inside depth of the furnace and half of an inside width of the furnace.

7. A combustion apparatus according to claim 6, wherein said corresponding imaginary circles of said burners and said additional burners comprise imaginary circles having different diameters.

8. A combustion apparatus according to claim 7, wherein at least one of the burners is disposed so that the injection direction axis line thereof is at a right angle to the furnace wall surface on which the burner is disposed.

9. A combustion apparatus according to claim 6, wherein at least one of the burners is disposed so that the injection direction axis line thereof is at a right angle to the furnace wall surface on which the burner is disposed.

10. A combustion apparatus according to claim 5, wherein said corresponding imaginary circles of said burners and said additional burners comprise imaginary circles having different diameters.

11. A combustion apparatus according to claim 10, wherein at least one of the burners is disposed so that the injection direction axis line thereof is at a right angle to the furnace wall surface on which the burner is disposed.

12. A combustion apparatus according to claim 5, wherein at least one of the burners is disposed so that the injection direction axis line thereof is at a right angle to the furnace wall surface on which the burner is disposed.

* * * * *